US007754092B2

(12) United States Patent
Materniak et al.

(10) Patent No.: US 7,754,092 B2
(45) Date of Patent: Jul. 13, 2010

(54) SOIL RESIST ADDITIVE

(75) Inventors: Joyce Monson Materniak, Hockessin, DE (US); Edward Patrick Carey, Atglen, PA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 12/191,342

(22) Filed: Aug. 14, 2008

(65) Prior Publication Data

US 2009/0110870 A1 Apr. 30, 2009

Related U.S. Application Data

(60) Provisional application No. 61/001,145, filed on Oct. 31, 2007.

(51) Int. Cl.
*D06M 15/576* (2006.01)
*D06M 15/00* (2006.01)

(52) U.S. Cl. ..... 252/8.61; 252/8.62; 252/8.63; 252/8.91; 8/115.51; 8/115.6; 427/389.9; 427/393.1; 428/96; 428/423.1; 428/423.4; 442/93; 442/94; 442/95; 510/517; 510/518; 510/528

(58) Field of Classification Search ..... 252/8.61, 252/8.62, 863, 8.91; 427/389.9, 393.1; 428/96, 428/423.1, 423.4; 8/115.51, 115.6; 442/93, 442/94, 95; 510/517, 518, 528
See application file for complete search history.

(56) References Cited

U.S. PATENT DOCUMENTS

| | | | | |
|---|---|---|---|---|
| 4,043,964 | A | | 8/1977 | Sherman et al. |
| 4,351,736 | A | | 9/1982 | Steinberger et al. |
| 4,781,844 | A | | 11/1988 | Kortmann et al. |
| 4,875,901 | A | | 10/1989 | Payet et al. |
| 4,962,156 | A | | 10/1990 | Shinjo et al. |
| 5,100,954 | A | | 3/1992 | Itoh et al. |
| 5,252,232 | A | * | 10/1993 | Vinod ..... 252/8.62 |
| 5,414,111 | A | | 5/1995 | Kirchner |
| 5,481,027 | A | | 1/1996 | Kirchner |
| 5,654,068 | A | | 8/1997 | Pechhold |
| 5,714,082 | A | | 2/1998 | Boardman et al. |
| 5,753,569 | A | | 5/1998 | Michels et al. |
| 6,013,732 | A | | 1/2000 | Yamana et al. |
| 6,071,869 | A | | 6/2000 | Materniak et al. |
| 6,162,369 | A | | 12/2000 | Allewaert et al. |
| 6,193,955 | B1 | | 2/2001 | Yamana et al. |
| 6,239,247 | B1 | | 5/2001 | Allewaert et al. |
| 6,613,862 | B2 | | 9/2003 | Clark et al. |
| 6,616,856 | B1 | | 9/2003 | Pacifici et al. |
| 6,740,251 | B2 | | 5/2004 | Materniak et al. |
| 6,790,905 | B2 | | 9/2004 | Fitzgerald et al. |
| 6,811,854 | B1 | | 11/2004 | Sato et al. |
| 6,824,854 | B2 | | 11/2004 | Materniak et al. |
| 7,078,456 | B2 | | 7/2006 | Jariwala et al. |
| 2002/0102382 | A1 | | 8/2002 | Kwong et al. |
| 2003/0008078 | A1 | | 1/2003 | Soane et al. |
| 2004/0147188 | A1 | | 7/2004 | Johnson et al. |
| 2006/0062968 | A1 | * | 3/2006 | Elgarhy ..... 428/171 |
| 2007/0004895 | A1 | | 1/2007 | Elsbernd et al. |
| 2007/0014927 | A1 | | 1/2007 | Buckanin et al. |
| 2007/0136953 | A1 | * | 6/2007 | Materniak et al. ..... 8/115.51 |

FOREIGN PATENT DOCUMENTS

| | | | |
|---|---|---|---|
| EP | 0 467 570 | A2 | 7/1991 |
| JP | 56129281 | | 10/1981 |
| JP | 58004873 | | 1/1983 |
| JP | 59109574 | | 6/1984 |
| JP | 59168184 | | 9/1984 |
| JP | 02299837 | | 12/1990 |
| JP | 04363370 | | 12/1992 |
| JP | 2872387 | B2 | 3/1999 |
| JP | 2006328624 | | 12/2006 |
| WO | WO98/18892 | A2 * | 5/1998 |
| WO | WO 99/57361 | | 11/1999 |

OTHER PUBLICATIONS

Honda et al., Molecular Aggregation Structure and Surface Properties of Poly(fluoroalkyl acrylate) Thin Films; Macromolecules (2005), 38(13), 5699-5705, American Chemical Society.

* cited by examiner

*Primary Examiner*—Anthony J Green
(74) *Attorney, Agent, or Firm*—Nancy S. Mayer

(57) ABSTRACT

A composition comprising a mixture of at least one soil resist agent and at least one additive which is maleic anhydride, and a method of providing soil resistance to fibrous substrates are disclosed.

16 Claims, No Drawings

SOIL RESIST ADDITIVE

This application claims the benefit of U.S. Provisional Application No. 61/001,145, filed Oct. 31, 2007.

FIELD OF THE INVENTION

The present invention is generally directed to compositions and methods for treatment of fibrous substrates with soil resist agents, either alone or in combination with simultaneous addition of stain resist agents. The invention is more particularly directed to chemical additives that enhance the performance of the soil resist agents on fibrous substrates.

BACKGROUND OF THE INVENTION

Fluoropolymers that are available in the form of anionically, cationically, or nonionically dispersed fluorinated polymer emulsions are commonly used as soil resist agents for fibrous substrates, such as carpets, rugs, and textiles. Such soil resist agents act by providing water- and oil-repellency and soil resistance to treated substrates. Resistance to acid dye stains such as food and beverage stains is provided by solutions of hydrolyzed maleic anhydride copolymers, copolymers of methacrylic acid and esters thereof, or sulfonated phenolic resins and blends thereof. An example of a food and beverage stain is the acid dye stain FD&C Red #40, commonly used in beverages.

Most commercially available fluorinated polymers useful as treating agents for imparting surface effects to substrates contain predominately eight or more carbons in the perfluoroalkyl chain to provide the desired repellency properties. Honda et al., in Macromolecules, 2005, 38, 5699-5705 show that for perfluoroalkyl chains of 8 carbons or greater, orientation of the perfluoroalkyl groups is maintained in a parallel configuration, while reorientation occurs for such chains having 6 carbon atoms or less. Such reorientation decreases surface properties such as receding contact angle. Thus, shorter chain perfluoroalkyls have traditionally not been successful commercially.

It is desired to improve surface effects, in particular soil resistance, of fibrous substrates, and to increase the fluorine efficiency; i.e., boost the efficiency or performance of treating agents so that lesser amounts of the expensive fluorinated polymer are required to achieve the same level of performance, or so that better performance is achieved using the same level of fluorine. It is desirable to reduce the chain length of the perfluoroalkyl groups thereby reducing the amount of fluorine present, while still achieving the same or superior surface effects.

Payet et al. in U.S. Pat. No. 4,875,901, disclosed the use of divalent metal salts, such as magnesium salts, as additives to stabilize fluorochemical oil and water repellents and stain resist resins in the treatment bath for coapplication of soil resist and stain resist agents. However, as noted by Pacifici in U.S. Pat. No. 6,616,856, Payet's single step process did not gain commercial acceptance, primarily due to inconsistent water and oil repellency effectiveness and its consequent failure to meet carpet industry standards. The inconsistency resulted from the stain-resist's tendency to interfere with the fluorochemical soil resist curing process, a thermal reorientation of the fluorochemical molecules. Pacifici substituted a naphthalene-sulfonated salt as a fluorochemical anti-coalescing agent in a single bath process. Pacifici did not address the use of cationically dispersed fluorochemical-based repellent emulsions (as a soil resist agent) in combination with stain resists.

There is a need for copolymer compositions that impart significant soil resistance to fibrous substrates while having perfluoroalkyl groups with six or less carbon atoms. There is also a need for additives that allow for such soil resist agents to be combined with other treatment agents, such as stain resist agents, in aqueous dilutions to be applied simultaneously while still enhancing the soil resist performance. The present invention provides such compositions.

SUMMARY OF THE INVENTION

The present invention comprises a composition comprising a mixture of at least one soil resist agent and an additive which is maleic anhydride.

The present invention further comprises a method for providing soil resistance to substrates comprising contacting the substrate with a single medium containing a mixture comprising at least one soil resist agent and maleic anhydride.

The present invention further comprises a substrate to which has been applied a composition comprising a mixture of at least one soil resist agent and maleic anhydride.

DETAILED DESCRIPTION

Herein trade names and trademarks are shown in upper case.

By the use herein of the term "soil resist" is meant a soil resist agent comprising a composition for application to a substrate to reduce soiling and provide repellency.

The term "polymethyl(meth)acrylate" as used herein denotes polymethylmethacrylate or polymethylacrylate.

The present invention comprises a mixture comprising at least one soil resist and maleic anhydride. The mixture provides excellent soil resistance when applied to fibrous substrates. The mixture is in the form of a solution, a dispersion, or a combination of solution and dispersion. It has been found that by including the additive maleic anhydride with a soil resist agent that the significant soil resistance is imparted to fibrous substrates while having perfluoroalkyl groups with six or less carbon atoms. Further such a composition can be applied in the presence of other treatment agents, such as a stain resist agent, while maintaining a high level of soil resistance.

Soil resist agents suitable for use in the composition of the present invention are commercially available and comprise fluorinated polyurethanes, a polymer or copolymer containing fluorinated acrylates or a polymer or copolymer containing fluorinated methacrylates. The preferred soil resist agents contain perfluoroalkyl groups of the following formula $R_f(CH_2)_n$— wherein $R_f$ is a straight or branched perfluoroalkyl having from about 2 to about 20 carbon atoms, (n is an integer of 1 to about 20) or a mixture thereof, where the perfluoroalkyl is optionally interrupted by at least one oxygen atom or methylene group. Perfluoroalkyl groups wherein n is about 2 to about 6 are preferred and wherein n is about 4 to about 6 are more preferred. The polymeric fluorochemical soil resist is anionically, cationically, or nonionically dispersed. Fluorochemical soil resists for application to fibrous substrates such as carpets, rugs, and textiles are commercially available from, but not limited to, E. I. du Pont de Nemours and Company, 3M, Daikin, Clariant, and Asahi. Commercially available soil resists, other soil resists known in the art, as well as combinations of these, are suitable for use in the present invention.

One example of a preferred soil resist is a polymeric fluorochemical soil resist that is cationically dispersed and prepared as disclosed in U.S. Pat. No. 6,790,905, herein incorporated by reference. An additional preferred soil resist is an anionically dispersed fluorinated polyurethane soil resist prepared according to Example 8 in U.S. Pat. No. 5,414,111, herein incorporated by reference.

Maleic anhydride is commercially available and can be obtained from Sigma Aldrich, USA, and other sources. The ratio of soil resist agent to maleic anhydride additive in the composition of the present invention is from about 0.5:1 to about 50:1, preferably from about 1:1 to about 40:1, and more preferably from about 3:1 to about 30:1.

In a preferred embodiment of the present invention, the composition comprises at least one soil resist agent, maleic anhydride, and polymethyl(meth)acrylate. The ratio of soil resist agent to polymethyl(meth)acrylate is from about 0.5:1 to about 20:1 on a 100% solids weight basis, preferably from about 1:1 to 10:1 on a 100% solids weight basis, and more preferably from about 2:1 to 6:1 on a 100% solids weight basis.

Other surface effect treatment agents can be applied simultaneously with, or sequentially to, the composition of the present invention to the fibrous substrate. Such additional components comprise compounds or compositions that provide surface effects such as no iron, easy to iron, shrinkage control, wrinkle free, permanent press, moisture control, softness, strength, anti-slip, anti-static, anti-snag, anti-pill, stain repellency, stain resistance, stain release, odor control, antimicrobial, sun protection, and similar effects. One or more such treating agents or finishes can be combined with the composition of the present invention and applied to the fibrous substrate. Other additives commonly used with such treating agents or finishes may also be present such as surfactants, foaming agents, lubricants, sequestering agents, leveling agents, pH adjusters, cross linkers, blocked isocyanates, hydrocarbon extenders, wetting agents, wax extenders, stain resist agents, and other additives known by those skilled in the art. Suitable surfactants include anionic, cationic, nonionic, and amphoteric.

The present invention further comprises a method of providing soil resistance to fibrous substrates comprising contacting the substrate with a single medium comprising a soil resist agent and maleic anhydride. The fibrous substrate is passed through the application apparatus and the soil resist is exhausted or deposited onto the substrate from a single application medium, such as a bath, containing the composition of the present invention. The present invention includes the use of a mixture of the soil resist agent and additive optionally with other additives, in a bath or other treatment medium. As previously noted, polymethyl(meth)acrylate is a preferred optional additive. The composition is applied to the fibrous substrate in a process such as an exhaustion, for example a Beck or Winch method, or by use of other conventional application methods known in the art. These include continuous methods such as, but not limited to, Flex-nip, pad, spray, foam, dip, brush, and roll coating application. Continuous methods of application can include steaming after application of the composition of the present invention. The substrate can be cured and dried after the application.

The composition can be applied as a thread-line application. The composition is applied at a mill, by a retailer or installer prior to installation, on a newly installed substrate such as carpet, or as part of a cleaning or refurbishing process to installed carpet.

The components of the present invention are added separately or as a premix to a bath or other treatment or contacting medium. A preferred sequence of addition is the additive (pre-dissolved in water), followed by the soil resist, and then pH adjustment. A stain resist should not be mixed with the soil resist or vice versa before the additive has been added. Optionally, as noted above, other conventional additives may be added to the composition or treatment medium, such as chemicals to adjust pH (for instance urea sulfate, or other acid), sequestering agents (such as ethylene diamine tetraacetic acid), additional surfactants, foaming agents, lubricants, leveling agents, and the like.

Conventional bath conditions can be used for the contacting medium. For example, for an exhaust application, an application period of from about 5 minutes to about 30 minutes and preferably about 20 minutes is employed. The bath to fiber weight ratio is from about 40:1 to about 2:1. The bath pH is from about 1 to about 9, preferably about 1.5 to about 5.0, and more preferably about 1.8 to about 3.0. The bath temperature is from about 160° F. to about 200° F. (from about 71° C. to about 93° C.), and preferably about 190° F. (about 88° C.). Lower pH and higher temperature improve exhaust efficiency but the more extreme conditions may adversely affect equipment. These conditions are balanced with operating and maintenance costs. After application of the composition of the present invention to the substrate, the fibrous substrate is rinsed and dried conventionally.

Continuous application methods can be used for the contacting medium such as, but not limited to, Flex-nip, pad, spray, foam, dip, brush, and roll coating. Continuous methods of application can include steaming after application of the composition of the present invention. The substrate can be cured and dried after the application.

The amount of additive present in the contacting medium for application to a substrate is from about 0.01 g/L to about 2 g/L, preferably from about 0.02 g/L to about 1.7 g/L, and more preferably from about 0.03 g/L to about 1.5 g/L. The amount of mixture (composition of the present invention) contacting the substrate is from about 0.01 to about 5 percent solids on weight of fiber, preferably from about 0.02 to about 4% solids on weight of fiber, and more preferably from about 0.03 to about 3% solids on weight of fiber.

The present invention further comprises a substrate treated with the composition of the present invention as disclosed above. Most any fibrous substrate is suitable for treatment by the compositions and methods of the present invention. Such substrates include fibers, yarns, fabrics, fabric blends, textiles, carpet, rugs, nonwovens, leather and paper. The term "fiber" includes fibers and yarns, before and after spinning, of a variety of compositions and forms, and includes pigmented fibers and pigmented yarns. By "fabrics" is meant natural or synthetic fabrics, or blends thereof, composed of fibers such as cotton, rayon, silk, wool, polyester, polypropylene, polyolefins, nylon, and aramids such as "NOMEX" and "KEVLAR." By "fabric blends" is meant fabric made of two or more different fibers. Typically these blends are a combination of at least one natural fiber and at least one synthetic fiber, but also can be a blend of two or more natural fibers and/or of two or more synthetic fibers. Carpets, for example, can be made of cotton, wool, silk, nylon, acrylics, aromatic polyamides, polyesters, jute, sisal, and other cellulosics.

The compositions and methods of the present invention are useful to provide soil resistance to fibrous substrates with increased fluorine efficiency. The treated substrates maintain excellent resistance to soiling over time. The compositions of the present invention are useful on a variety of fibrous substrates such as carpets, textiles, and fabrics benefiting consumers in multiple usage situations. The additives of the present invention solve the problem of imparting significant soil resistance to fibrous substrates while having perfluoroalkyl groups with six or less carbon atoms. The present invention also allows for such soil resist agents to be combined with other treatment agents, such as stain resist agents, in aqueous dilutions to be applied simultaneously while still enhancing the soil resist performance.

Materials and Test Methods

The following materials and test methods were used in the Examples set forth below.

Materials

Stain Resist 1

Stain Resist 1 was a blend of an aqueous solution of a partial sodium salt of a hydrolyzed octene/maleic anhydride copolymer and sulfonated phenolic resin, prepared according to U.S. Pat. No. 5,654,068, and commercially available from E. I. du Pont de Nemours and Company, Wilmington, Del.

Soil Resist 1

Soil Resist 1 was prepared as follows. A 4-neck 2 liter round bottom reaction flask equipped with an overhead stirrer, addition funnel, temperature probe, and condenser with nitrogen inlet was purged with nitrogen and heated to remove moisture. Upon cooling, Desmodur N3300, a cyclic isocyanate available from Bayer, (250.0 g, 1.3 mol active isocyanate), methylisobutylketone (MIBK) 146.83 g, and 40 g dibutyltindilaurate solution (0.004 g/g MIBK) were added and the reaction mixture was heated to 60° C. 3,3,4,4,5,5,6,6,7,7,8,8,8-tridecafluorooctan-1-ol (367.74 g, 1.01 mol) was added drop-wise resulting in an exotherm (~20° C.). The reaction was held at 84° C. for 3 additional hours. Deionized water (10.44 g, 0.58 mol) in 470.9 g MIBK were added to the solution via addition funnel and the reaction was heated at 84° C. until the isocyanate was reacted as detected using a Colormetric Technologies, Inc isocyanate test strip—usually 6 hours. The crude product in MIBK (400.0 g) was heated to 60° C. and added to a surfactant solution (32.0 g Witco C-6094 and 472.0 g deionized water) also at 60° C. The solution was homogenized using a digital sonifier for 5 minutes and MIBK was removed via vacuum distillation to remove MIBK. The product was standardized to 21.3% solids.

Soil Resist 2

Soil resist 2 was an anionically-dispersed fluorinated polyurethane soil resist prepared according to Example 8 in U.S. Pat. No. 5,414,111, available from E. I. du Pont de Nemours and Company, Wilmington Del. This contains a perfluoroalkyl group having a mixture of 4 to 20 carbons.

Soil Resist 3

Soil resist 3 was an anionically-dispersed fluorinated polyurethane soil resist prepared according to Example 8 in U.S. Pat. No. 5,414,111, available from E. I. du Pont de Nemours and Company, Wilmington Del. This contains a perfluoroalkyl group having a mixture of 4 to 20 carbons and less surfactant than Soil Resist 2.

Soil Resist 4

Soil resist 4 was prepared as follows. A 4-neck 2 liter round bottom reaction flask equipped with an overhead stirrer, addition funnel, temperature probe, and condenser with nitrogen inlet was purged with nitrogen and heated to remove moisture. Upon cooling, Desmodur N100, a noncyclic isocyanate available from Bayer, (200.0 g, 0.657 mol active isocyanate), methylisobutylketone (MIBK) 117.46 g, and 21 g dibutyltindilaurate solution (0.004 g/g MIBK) were added and the reaction mixture was heated to 60° C. 3,3,4,4,5,5,6,6,7,7,8,8,8-tridecafluorooctan-1-ol (189.4 g, 0.520 mol) was added drop-wise resulting in an exotherm (~20° C.). The reaction was held at 84° C. for 3 additional hours. Deionized water (4.92 g, 0.273 mol) in 271.97 g MIBK were added to the solution via addition funnel and the reaction was heated at 84° C. until the isocyanate was reacted as detected using a Colormetric Technologies, Inc isocyanate test strip—usually 6 hours. The crude product in MIBK (100.0 g) was heated to 60° C. and added to a surfactant solution (8.0 g Witco C-6094 and 140.0 g deionized water) also at 60° C. The solution was homogenized using a digital sonifier for 5 minutes and MIBK was removed via vacuum distillation to remove MIBK. The product was standardized to 16.2% solids.

Test Methods

Test Method 1—Soil Resistance

A drum mill (on rollers) was used to tumble synthetic soil onto carpet samples. Synthetic soil was prepared as described in AATCC Test Method 123-2000, Section 8. Soil-coated beads were prepared as follows. Synthetic soil, 3 g, and 1 liter of clean nylon resin beads (SURLYN ionomer resin beads ⅛-3⁄16 inch (0.32-0.48 cm) diameter were placed into a clean, empty canister. SURLYN is an ethylene/methacrylic acid copolymer, available from E. I. du Pont de Nemours and Co., Wilmington Del.). The canister lid was closed and sealed with duct tape and the canister rotated on rollers for 5 minutes. The soil-coated beads were removed from the canister.

Carpet samples to insert into the drum were prepared as follows. Total carpet sample size was 8×25 inch (20.3×63.5 cm) for these tests. One test sample and one control sample were tested at the same time. The carpet pile of all samples was laid in the same direction. The shorter side of each carpet sample was cut in the machine direction (with the tuft rows). Strong adhesive tape was placed on the backside of the carpet pieces to hold them together. The carpet samples were placed in the clean, empty drum mill with the tufts facing toward the center of the drum. The carpet was held in place in the drum mill with rigid wires. Soil-coated resin beads, 250 cc, and 250 cc of ball bearings (5⁄16 inch, 0.79 cm diameter) were placed into the drum mill. The drum mill lid was closed and sealed with duct tape. The drum was run on the rollers for 2½ minutes at 105 rpm. The rollers were stopped and the direction of the drum mill reversed. The drum was run on the rollers for an additional 2½ minutes at 105 rpm. The carpet samples were removed and vacuumed uniformly to remove excess dirt. The soil-coated beads were discarded.

The Delta E color difference for the soiled carpet was measured for the test and control items versus the original unsoiled carpet. Color measurement of each carpet was conducted on the carpet following the accelerated soiling test. For each control and test sample the color of the carpet was measured, the sample was soiled, and the color of the soiled carpet was measured. The Delta E is the difference between the color of the soiled and unsoiled samples, expressed as a positive number. The color difference was measured on each item, using a Minolta Chroma Meter CR-310. Color readings were taken at five different areas on the carpet sample, and the average Delta E was recorded. The control carpet for each test item was of the same color and construction as the test item. The control carpet had not been treated with any fluorochemical. A lower Delta E indicates less soiling and superior soil resistance.

Test Method 2—Water Repellency

Water repellency was measured according to AATCC Test Method 193. Higher values indicate increased water repellency.

The water repellency of a treated substrate was measured according to AATCC standard Test Method No. 193-2004 and the DuPont Technical Laboratory Method as outlined in the TEFLON Global Specifications and Quality Control Tests information packet. The test determines the resistance of a treated substrate to wetting by aqueous liquids. Drops of water-alcohol mixtures of varying surface tensions are placed on the substrate and the extent of surface wetting is determined visually. The higher the water repellency rating, the better the resistance of a finished substrate to staining by water-based substances.

The water repellency test liquids are shown in Table 1.

TABLE 1

Water Repellency Test Liquids

| Water Repellency Rating Number | Composition, Isopropyl Alcohol | Vol % Distilled Water |
|---|---|---|
| 1 | 2 | 98 |
| 2 | 5 | 95 |
| 3 | 10 | 90 |
| 4 | 20 | 80 |
| 5 | 30 | 70 |
| 6 | 40 | 60 |
| 7 | 50 | 50 |
| 8 | 60 | 40 |
| 9 | 70 | 30 |
| 10 | 80 | 20 |
| 11 | 90 | 10 |
| 12 | 100 | 0 |

Testing procedure: Three drops of Test Liquid 1 are placed on the treated substrate. After 10 seconds, the drops are removed by using vacuum aspiration. If no liquid penetration or partial absorption (appearance of a darker wet patch on the substrate) is observed, the test is repeated with Test Liquid 2. The test is repeated with Test Liquid 3 and progressively higher Test Liquid numbers until liquid penetration (appearance of a darker wet patch on the substrate) is observed. The test result is the highest Test Liquid number that does not penetrate into the substrate. Higher scores indicate greater repellency.

Test Method 3—Oil Repellency

Oil repellency was measured according to AATCC Test Method 118. Higher values indicate increased oil repellency.

The treated samples were tested for oil repellency by a modification of AATCC standard Test Method No. 118, conducted as follows. A substrate treated with an aqueous dispersion of polymer as previously described, is conditioned for a minimum of 2 hours at 23° C. and 20% relative humidity and 65° C. and 10% relative humidity. A series of organic liquids, identified below in Table 2, are then applied dropwise to the samples. Beginning with the lowest numbered test liquid (Repellency Rating No. 1), one drop (approximately 5 mm in diameter or 0.05 mL volume) is placed on each of three locations at least 5 mm apart. The drops are observed for 30 seconds. If, at the end of this period, two of the three drops are still spherical in shape with no wicking around the drops, three drops of the next highest numbered liquid are placed on adjacent sites and similarly observed for 30 seconds. The procedure is continued until one of the test liquids results in two of the three drops failing to remain spherical to hemispherical, or wetting or wicking occurs.

The oil repellency rating is the highest numbered test liquid for which two of the three drops remained spherical to hemispherical, with no wicking for 30 seconds. In general, treated samples with a rating of 5 or more are considered good to excellent; samples having a rating of one or greater can be used in certain applications.

TABLE 2

Oil Repellency Test Liquids

| Oil Repellency Rating Number | Test Solution |
|---|---|
| 1 | NUJOL Purified Mineral Oil |
| 2 | 65/35 NUJOL/n-hexadecane by volume at 21° C. |
| 3 | n-hexadecane |
| 4 | n-tetradecane |
| 5 | n-dodecane |
| 6 | n-decane |
| 7 | n-octane |
| 8 | n-heptane |

Note:
NUJOL is a trademark of Plough, Inc., for a mineral oil having a Saybolt viscosity of 360/390 at 38° C. and a specific gravity of 0.880/0.900 at 15° C.

Test Method 4

Cherry KOOL-AID (KOOL-AID is a trademark of Kraft General Foods, Inc., White Plains N.Y.) stain testing was conducted on carpet samples 15 cm by 15 cm. Acid dye stain resistance was evaluated using a procedure based on the American Association of Textile Chemists and Colorists (AATCC) Method 175, "Stain Resistance: Pile Floor Coverings." A staining solution was prepared by mixing sugar sweetened cherry KOOL-AID (36.5 g) and 500 mL water. The carpet sample to be tested was placed on a flat non-absorbent surface and a hollow plastic cylinder having a 2-inch (5-cm) diameter was placed tightly over the carpet sample. KOOL-AID staining solution (20 mL) was poured into the cylinder, which had been previously placed on the carpet sample. The stain was gently worked into the carpet. The cylinder was then removed and the stained carpet sample was allowed to sit undisturbed for 24 hours. Then the carpets were rinsed thoroughly under cold tap water for at least 10 minutes until the rinse water was clear. The carpet samples were extracted, and air-dried for 24 hours on a non-absorbent surface. The KOOL-AID stains obtained by this procedure were rated with a visual stain rating scale (AATCC Red 40 Stain Scale) from AATCC Test Method 175. A visual rating of 10 (complete stain removal) to 1 (maximum or unchanged stain) was obtained by using the AATCC Red 40 Stain Scale (Test Method #175) with the KOOL-AID stains having the same discoloration as the numbered colored film.

EXAMPLES

Example 1

A concentrated mixture was prepared by physically mixing the following components as weight percents: 0.58% of maleic anhydride (aqueous solution), 2.49% of hydrolyzed maleic anhydride copolymer stain resist, 0.19% sodium alkyl sulfate surfactant, 13.97% Soil Resist 1, 3% polymethacrylate, and 79.77% water. The weight percent of the components was based on 100% solids. The mixture was observed for stability and the results are in Table 3.

The mixture of this Example 1 was applied to carpet which was beige nylon 6,6 residential cut-pile carpet having 45 oz/square yard (1.53 kg/square meter), which had been treated with Stain Resist 1. The composition was applied to the carpet with spray application at 25% wet pick-up with a goal of 300 ppm (microgram per gram) fluorine on the carpet fiber weight. This application of the formulation of Example 1 onto the carpet at the goal loading level of 300 ppm (micrograms per gram) fluorine consists of 0.003 weight % of maleic anhydride on fiber at 100% solids basis, 0.015 weight % of hydrolyzed maleic anhydride copolymer on fiber at 100% solids basis, 0.001 weight % of sodium alkyl sulfonate surfactant on fiber at 100% solids basis, 0.085 weight % of Soil Resist 1 on fiber at 100% solids basis, and 0.0175 weight % of polymethyl(meth)acrylate on fiber at 100% solids basis. This was followed by an oven cure to achieve a face fiber temperature of 250° F. (121° C.) for at least one minute. The carpet was tested according to Test Methods 1, 2, and 3. Results are in Table 4.

Comparative Example A

A concentrated mixture was prepared by physically mixing the following components as weight percents: 2.49% of hydrolyzed maleic anhydride copolymer stain resist, 0.19% sodium alkyl sulfate surfactant, 13.97% Soil Resist 1, 3% polymethacrylate, and 80.35% water. The weight percent of the components was based on 100% solids. This mixture was the same as Example 1 but without the maleic anhydride additive. The mixture was observed for stability and the results are in Table 3.

TABLE 3

| Example | 24 hour stability test at ambient temperature | 24 hour oven stability test at 122° F. (50° C.) |
|---|---|---|
| 1 | Stable | Stable |
| A | Not stable | Not stable |

Comparative Example B

Comparative B was prepared by applying Soil Resist 2 to the same carpet substrate as Example 1 and with the same application method as Example 1. Comparative Example B was applied to a goal of 600 ppm fluorine on the carpet fiber weight. This application of the formulation of Comparative Example B onto the carpet at the goal loading level of 600 ppm (micrograms per gram) fluorine consists of 0.17 weight % of fluorinated urethane on fiber at 100% solids basis. This carpet was tested according to Test Methods 1, 2 and 3. Results are reported in Table 4.

TABLE 4

| Example | goal ppm F | drum soil delta E | delta delta E vs. control | Repellency oil | Repellency water |
|---|---|---|---|---|---|
| Comparative B | 600 | 14.7 | | 1 | 4 |
| Example 1 | 300 | 12.84 | −1.86 | 2 | 5 |

Example 1 showed less soiling in the drum soil test vs. Comparative Example B at half the level of fluorine loading of the Comparative Example B. Lower delta E indicated less soiling. A negative delta delta E vs. Comparative Example B indicated lower soiling. Repellency was also improved vs. Comparative Example B with half of the fluorine level.

Example 2

A concentrated mixture was prepared for Example 2 by physically mixing 0.92% of maleic anhydride (aqueous solution), 3.39% of hydrolyzed maleic anhydride copolymer stain resist, 0.3% sodium alkyl sulfate surfactant, 3.6% Soil Resist 1 and 91.79% water. The weight % of the components is based on the 100% solids contribution. This composition was applied to carpet. The carpet used for the application was 28 oz/square yard (0.95 kg/square meter) beige nylon 6,6 commercial level loop carpet. The composition was applied to the carpet with spray application at 25% wet pick-up with a goal of 800 ppm (microgram per gram) fluorine on the carpet fiber weight followed by oven cure to achieve a face fiber temperature of 250° F. (121° C.) for at least one minute. This carpet was tested according to Test Methods 1 and 4. Results are reported in Table 5.

Example 3

A concentrated mixture was prepared for Example 3 by physically mixing 0.92% of maleic anhydride (aqueous solution), 3.39% of hydrolyzed maleic anhydride copolymer stain resist, 0.3% sodium alkyl sulfate surfactant, 3.6% Soil Resist 4 and 91.79% water. The weight % of the components is based on the 100% solids contribution. This composition was applied to carpet. Carpet used for the application was 28 oz/square yard (0.95 kg/square meter) beige nylon 6,6 commercial level loop carpet. The composition was applied to the carpet with spray application at 25% wet pick-up with a goal of 800 ppm (micrograms per gram) fluorine on the carpet fiber weight followed by oven cure to achieve a face fiber temperature of 250° F. (121° C.) for at least one minute. This carpet was tested according to Test Methods 1 and 4 (the accelerated drum soil test and the 24 hour Kool-aid stain tests). Results are reported in Table 5.

Comparative Example C

Comparative Example C was prepared by applying Soil Resist 3 to the same carpet substrate as Examples 2 and 3, and with the same application method as used in Examples 2 and 3. Comparative C was applied to a goal of 800 ppm (micrograms per gram) fluorine on the carpet fiber weight. This carpet was tested according to Test Methods 1 and 4 (the accelerated drum soil test and the 24 hour Kool-aid stain tests). Results are reported in Table 5.

TABLE 5

| Example | goal ppm F | drum soil delta E | delta delta E vs. control | 24 hour Kool-aid stain test |
|---|---|---|---|---|
| Comparative C | 800 | 7.61 | | 2 |
| Example 2 | 800 | 6.09 | −1.52 | 3 |
| Example 3 | 800 | 6.33 | −1.28 | 3 |

Examples 2-3 showed less soiling in the drum soil test vs. Comparative Example C. Lower delta E indicated less soiling. A negative delta delta E vs. Comparative Example C indicated lower soiling. Examples 2 and 3 also provided improved stain resistance for Kool-aid stains vs. Comparative Example C.

What is claimed is:

1. A composition comprising a mixture of 1) at least one soil resist agent comprising a fluorinated polyurethane containing a perfluoroalkyl group of the following formula $R_f(CH_2)_n$— wherein $R_f$ is a straight or branched perfluoroalkyl with six or less carbon atoms, and wherein n is an integer of from 1 to about 6, or a mixture thereof, wherein the perfluoroalkyl is optionally interrupted by at least one oxygen atom or methylene, and wherein the polyurethane is prepared using a cyclic isocyanate, and 2) at least one additive which is maleic anhydride.

2. The composition of claim 1 further comprising polymethyl(meth)acrylate.

3. The composition of claim 1 wherein the ratio of soil resist agent to additive is from about 0.5:1 to about 50:1 on a 10000 solids weight basis.

4. The composition of claim 2 wherein the ratio of soil resist agent to polymethyl(meth)acrylate is from about 0.5:1 to about 20:1.

5. The composition of claim 1 further comprising a compound or composition that provides a surface effect selected from the group consisting of no iron, easy to iron, shrinkage control, wrinkle free, permanent press, moisture control, softness, strength, anti-slip, anti-static, anti-snag, anti-pill, stain repellency, stain resistance, stain release, odor control, antimicrobial, and sun protection.

6. The composition of claim 1 further comprising surfactants, sequestering agents, leveling agents, pH adjusters, cross linkers, wetting agents, blocked isocyanates, hydrocarbon extenders, and wax extenders.

7. The composition of claim 1 in the form of a solution or dispersion, or a combination thereof.

8. A method for providing soil resistance to substrates comprising contacting the substrate with a single medium comprising a mixture of 1) at least one soil resist agent comprising a fluorinated polyurethane containing a perfluoroalkyl group of the following formula $R_f(CH_2)_n$— wherein $R_f$ is a straight or branched perfluoroalkyl with six or less carbon atoms, and wherein n is an integer of from 1 to about 6, or a mixture thereof, wherein the perfluoroalkyl is optionally interrupted by at least one oxygen atom or methylene, and wherein the polyurethane is prepared using a cyclic isocyanate, and 2) at least one additive which is maleic anhydride.

9. The method of claim 8 wherein the contacting comprises use of exhaustion, Flex-nip, pad, spray, foam, dip, brush, or roll coating.

10. The method of claim 8 wherein the ratio of soil resist agent to additive is from about 0.5:1 to about 50:1 on a 10000 solids weight basis.

11. The method of claim 8 wherein the amount of additive present in the medium is from about 0.01 g/L to about 2 g/L.

12. The method of claim 8 wherein the amount of mixture contacting the substrate is from about 0.01 to about 5 percent solids on weight of fiber.

13. A substrate to which has been applied from a single medium a composition comprising a mixture of 1) at least one soil resist agent comprising a fluorinated polyurethane containing a perfluoroalkyl group of the following formula $R_f(CH_2)_n$— wherein $R_f$ is a straight or branched perfluoroalkyl with six or less carbon atoms, and wherein n is an integer of from 1 to about 6, or a mixture thereof, wherein the perfluoroalkyl is optionally interrupted by at least one oxygen atom or methylene, and wherein the polyurethane is prepared using a cyclic isocyanate, and 2) maleic anhydride.

14. The substrate of claim 13 comprising a fibrous substrate.

15. The substrate of claim 13 which is a fiber, yarn, fabric, fabric blend, carpet, textile, nonwoven, leather or paper.

16. The substrate of claim 13 which is carpet.

* * * * *